US007574167B2

(12) United States Patent
Okamoto et al.

(10) Patent No.: US 7,574,167 B2
(45) Date of Patent: Aug. 11, 2009

(54) IMAGE FORMING APPARATUS

(75) Inventors: Akira Okamoto, Hino (JP); Satoshi Sakata, Hino (JP); Kenji Yamamoto, Hachioji (JP); Kazumichi Yamauchi, Hachioji (JP); Kazutoshi Yoshimura, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 286 days.

(21) Appl. No.: 11/519,119

(22) Filed: Sep. 11, 2006

(65) Prior Publication Data

US 2007/0127964 A1 Jun. 7, 2007

(30) Foreign Application Priority Data

Dec. 1, 2005 (JP) ..... 2005-347503

(51) Int. Cl.
*G03G 15/00* (2006.01)

(52) U.S. Cl. ..... 399/395; 399/306; 399/364; 399/401; 400/579

(58) Field of Classification Search ..... 399/306, 399/364; 271/248
See application file for complete search history.

(56) References Cited

U.S. PATENT DOCUMENTS

| | | | |
|---|---|---|---|
| 2001/0014235 A1 | 8/2001 | Ando et al. | |
| 2002/0110380 A1 | 8/2002 | McIntyre | |
| 2004/0190963 A1 | 9/2004 | Ito | |
| 2006/0051145 A1 * | 3/2006 | Ubayashi | 399/395 |

FOREIGN PATENT DOCUMENTS

| | | | |
|---|---|---|---|
| EP | 1418142 A2 | | 5/2004 |
| JP | 60223756 A | * | 11/1985 |
| JP | 06175438 A | | 6/1994 |
| JP | 06-234441 | | 8/1994 |
| JP | 06234441 A | | 8/1994 |
| JP | 2003155146 A | | 5/2003 |
| JP | 2005316336 A | | 11/2005 |

OTHER PUBLICATIONS

European Search Report for Application No. 06120271.9; Dated Aug. 27, 2008; with English translation.

* cited by examiner

*Primary Examiner*—Daniel J Colilla
*Assistant Examiner*—Allister Primo
(74) *Attorney, Agent, or Firm*—Cantor Colburn LLP

(57) ABSTRACT

An image forming apparatus having therein an image forming device that transfers an image onto a transfer sheet and a reversing device that reverses the transfer sheet, wherein the image forming device transfers an image on the front surface of the transfer sheet, then, the reversing device reverses the sheet, and the image forming device transfers an image onto the rear surface of the sheet and the image forming apparatus further has therein a correcting device that corrects the overall skew of the transfer sheet depending on an inclination of a leading side of a transfer sheet in the conveyance direction set in advance before an image is formed on the front surface, and corrects the overall skew of the transfer sheet depending on an inclination of a leading side of a transfer sheet in the conveyance direction set in advance before an image is formed on the rear surface.

11 Claims, 7 Drawing Sheets

IMAGE FORMING APPARATUS

This application is based on Japanese Patent Application No. 2005-347503 filed on Dec. 1, 2005 in Japanese Patent Office, the entire content of which is hereby incorporated by reference.

BACKGROUND OF THE INVENTION

The present invention relates to an image forming apparatus such as a copying machine or a printer, and in particular, to an image forming apparatus wherein a skew of a transfer sheet is corrected for image forming.

In the image forming apparatus such as a copying machine or a printer, a skew of transfer sheet has been corrected by registration rollers before image forming. With respect to correction of this skew, there has been an attempt wherein a skew of transfer sheet is detected automatically, and a tilt of registration rollers is changed based on the detected skew, thereby, a skew of transfer sheet is corrected (for example, Patent Document 1).

However, actual transfer sheet has no orthogonality, and corner angles of a sheet differ, depending on how sheets are cut. As shown in FIG. 7 (*a*), for example, an angle of a certain corner of transfer sheet P is 90° and an angle of another corner is 88.5°. There is also an occasion where a corner has a different angle on each transfer sheet. The following is considered as a reason why angles of corners are different on a transfer sheet, or why a corner angle is different for each transfer sheet. For example, there is an occasion wherein, when transfer sheets are cut by different cutting devices in a cutting process, a corner angle of transfer sheet differs depending on which cutting device cut the sheet. Or, there is an occasion where a corner angle differs depending on the size of transfer sheet. There is further an occasion where a corner angle differs depending on the manufacturer of transfer sheet even when transfer sheets are in the same size, when the transfer sheets are made by different manufacturers.

If corner angles of transfer sheet differ as stated above, there is sometimes an occasion where an image formed on the front surface and an image formed on the rear surface do not agree in terms of the position each other, even when a skew of transfer sheet is corrected by registration rollers.

When forming an image on the front surface of transfer sheet, for example, one end (a leading edge) of the transfer sheet P is made to hit a nip portion of registration rollers 43 so that a skew of the transfer sheet P is corrected as shown in FIG. 7(*b*), and after that, an image is formed on the front surface of image forming section. After the image is formed on the front surface, in the case where an image is formed on a rear surface of the transfer sheet, the transfer sheet is reversed by reversing path, reversing and conveying roller and reversing and conveying path, and is sent again to image forming section. Since the transfer sheet is reversed as stated above, the other end (trailing edge) of the transfer sheet P is made to hit a nip portion of registration rollers 43 as shown in FIG. 7 (*c*), and a skew of the transfer sheet P is corrected. After that, an image is formed on the rear surface by the image forming section.

However, since a skew angle of the leading edge is different from that of the trailing edge on transfer sheet P as shown in FIG. 7 (*a*), an image formed on the front surface is deviated from an image formed on the rear surface by a difference equivalent to the difference between the angles as shown in FIG. 7 (*c*), and it has been difficult to align an image on the front surface with an image on the rear surface accurately.

It is further difficult to detect an angle deviation automatically because an amount of the angle deviation of transfer sheet is extremely small, and it is difficult for the image forming apparatus relating to the Patent Document 1 to correct an angle deviation of transfer sheet.

(Patent Document 1) Unexamined Japanese Patent Application Publication No. 6-234441

SUMMARY

The problems mentioned above are solved by the present invention, and an object is to provide an image forming apparatus wherein, when forming images on both sides of a transfer sheet, the images formed on both sides can be aligned highly accurately.

An embodiment of the invention is an image forming apparatus having therein an image forming device that transfers an image onto a transfer sheet and a reversing device that reverses the transfer sheet, the image forming device transferring an image on the front surface of the transfer sheet, then, the reversing device reversing the transfer sheet, and the image forming device transferring an image onto the rear surface of the transfer sheet, wherein there is further provided a correcting device that corrects the overall skew of the transfer sheet depending on an amount of a skew of a side of a transfer sheet representing the leading edge in the conveyance direction established in advance, before an image is formed on the front surface of the transfer sheet and corrects the overall skew of the transfer sheet depending on an amount of a skew of a side of a transfer sheet representing the leading edge in the conveyance direction established in advance, before an image is formed on the rear surface of the transfer sheet.

DETAILED DESCRIPTION OF THE PREFERRED EMBODIMENT

Figure 6:
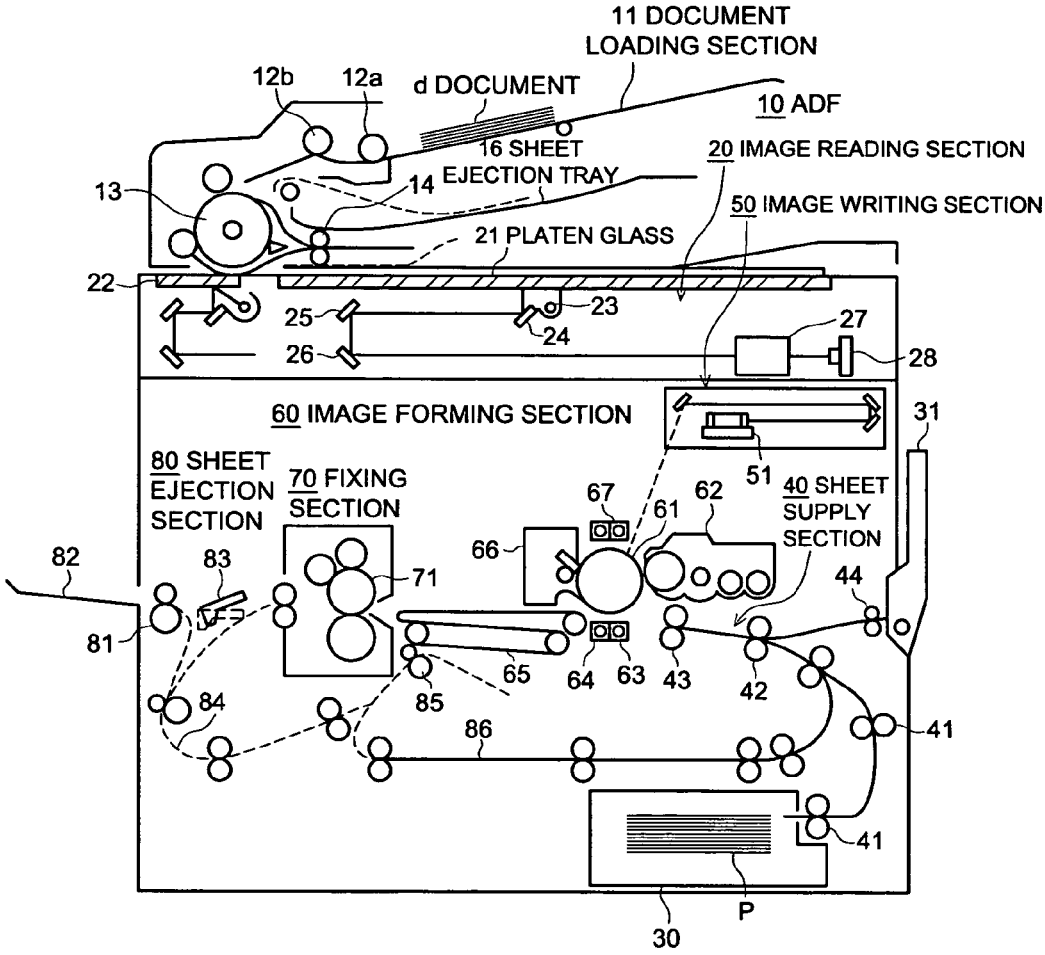
FIG. 6 is a cross-sectional view showing a constitution of an image forming apparatus.

The image forming apparatus such as a copying machine or a printer is equipped with an image carrier, an image writing section, a developing unit, a sheet-feeding tray, a transfer section and a fixing unit. Now, the constitution of the image forming apparatus will be explained as follows, referring to FIG. 6 which is a cross-sectional view showing the constitution of the image forming apparatus.

Automatic conveyance device 10 is a device to conduct conveyance for reading a document. A plurality of documents "d" being under the condition that the front surface of the first page of the documents faces upward are loaded on document loading section 11 which is for loading documents. Document "d" is fed out through roller 12*a* and roller 12*b*, and is conveyed to image reading section 20 through roller 13.

Then, the document "d" whose images have been read in the image reading section 20 is reversed by reversing rollers 14, to be ejected on sheet ejection tray 16 with its front surface facing downward.

The image reading section 20 scans the document optically to generate image data. An image surface of the document "d" is illuminated by light source 23, and its reflected light forms an image on a light-receiving surface of CCD 28 representing a photoelectric conversion device, through mirrors 24, 25 and 26 and combining optical system 27. Incidentally, when reading the document "d" by placing it on platen glass 21 so that the surface of the document "d" to be read may face downward, the optical system is moved for scanning along the platen glass 21 for the reading operation. Further, when reading the document "d", while conveying it, the reading operation is conducted under the condition the light source 23 and the mirror 24 are fixed under second platen glass 22. Image data of the document "d" which has been read are sent to an image processing section (not shown) from CCD 28. In the mean time, when the document "d" is conveyed for both side reading by automatic conveyance device 10, the document "d" is reversed and conveyed to roller 13 again through reversing rollers 14 after the front surface of the document "d" has been read, whereby, the rear surface of the document "d" is read by image reading section 20, and image data obtained through the reading are sent to an image processing section from CCD 28.

Transfer sheets P are loaded on sheet-feeding tray 30. Incidentally, though a single stage of sheet-feeding tray 30 is provided in the structure in FIG. 6, it is normal that a plurality of sheet-feeding trays are provided so that transfer sheets having different sizes may be loaded.

Sheet supply section 40 supplies transfer sheets P to image forming section 60 from sheet-feeding tray 30.

Transfer sheet P is fed out of the sheet-feeding tray 30 by conveyance roller 41, and is caused to hit a nip portion of registration rollers 43 through loop rollers 42 to be stopped temporarily, thereby, a skew of the transfer sheet P is corrected. Then, the transfer sheet P is conveyed to photoreceptor drum 61 of the image forming section 60 at prescribed timing. Further, the transfer sheet P is fed out of manual feed tray 31 by conveyance rollers 44, and is conveyed to photoreceptor drum 61 of the image forming section 60 through the same process flow as in the foregoing.

Image writing section 50 forms an electrostatic latent image on the photoreceptor drum 61 of the image forming section 60 based on image data of document "d" obtained through reading by the image reading section 20. When a laser beam emitted from laser diode 51 based on image data is irradiated on the photoreceptor drum 61 of the image forming section 60, the electrostatic latent image is formed.

The image forming section 60 records the electrostatic latent image formed on the photoreceptor drum 61 on transfer sheet P through an electrophotographic system. First, when a laser beam emitted from laser diode 51 of the image writing section 50 is irradiated on the photoreceptor drum 61 charged evenly by charging section 67, an electrostatic latent image is formed. Then the electrostatic latent image formed on the photoreceptor drum 61 is developed by developing unit 62 to form a toner image on the photoreceptor drum 61. This toner image is transferred onto transfer sheet P by transfer section 63 that is provided below the photoreceptor drum 61. Then, transfer sheet P that is in contact with the photoreceptor drum 61 is separated by separating section 64. The transfer sheet P separated from the photoreceptor drum 61 is conveyed to fixing unit 70 by conveyance mechanism 65.

The fixing unit 70 fixes a toner image transferred onto transfer sheet P through heat and pressure. The toner image transferred onto transfer sheet P is fixed by heat and pressure exerted from fixing roller 71.

Sheet ejection section 80 ejects transfer sheet P on which the image has been fixed. Transfer sheet P on which the image has been fixed is ejected to sheet ejection tray 82 by sheet ejection rollers 81. When forming images on both sides of a sheet, transfer sheet P is conveyed downward by guide 83, after the image formed on the front surface is fixed, and the transfer sheet P is sent to reversing path 84. The transfer sheet P having entered the reversing path 84 is conveyed to reversing conveyance path 86 by reversing conveyance rollers 85. The transfer sheet P having entered the reversing conveyance path 86 is conveyed again to image forming section 60 through sheet supply section 40.

Transfer sheet P is caused to hit a nip portion of registration rollers 43 through loop rollers 42 to be stopped temporarily, thereby, a skew of the transfer sheet P is corrected. Then, the transfer sheet P is conveyed to photoreceptor drum 61 of the image forming section 60 at prescribed timing.

On the image forming section 60, residual toner sticking to the photoreceptor drum 61 is removed by cleaning section 66, to be ready for the succeeding image forming. Under this condition, the transfer sheet P is conveyed to image forming section 60, and an image is formed on the other surface (rear surface). Then, the transfer sheet P separated from the photoreceptor drum 61 in the separation section 64 is sent again to fixing unit 70 through conveyance mechanism 65 to be fixed. In this way, transfer sheet P on which image fixing on each of the front surface and the rear surface has been terminated is ejected to sheet ejection tray 82 by sheet ejection rollers 81.

(Constitution)

Figure 1:
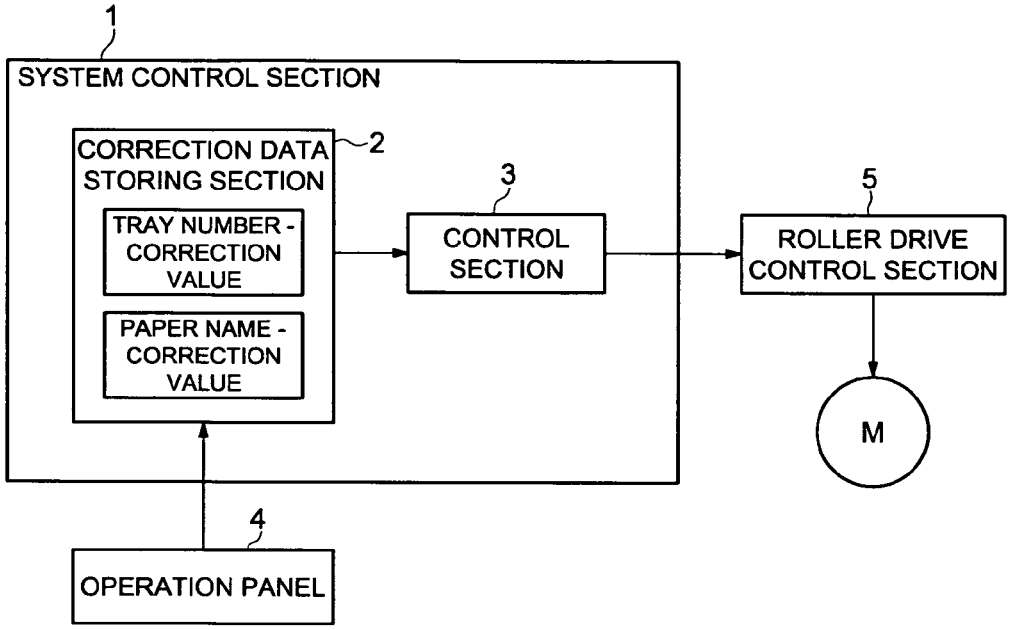
FIG. 1 is a block diagram showing a constitution of an image forming apparatus relating to the embodiment of the invention.

A constitution of an image forming apparatus relating to the embodiment of the invention will be explained as follows, referring to FIG. 1 which is a block diagram showing the constitution of an image forming apparatus relating to the embodiment of the invention.

The image forming apparatus relating to the present embodiment is composed of image reading section 20, sheet-feeding tray 30, sheet supply section 40, image writing section 50, image forming section 60, fixing section 70 and sheet ejection section 80 as mentioned above. Further, a pair of registration rollers for correcting a skew of transfer sheet P also has the aforesaid constitution.

Correction data storing section 2 stores therein a correction value for correcting a skew of transfer sheet P by means of registration rollers 43. This correction value contains an angle value and a direction showing a skew of transfer sheet P. The correction data storing section 2 further stores a correction value for correcting a skew of transfer sheet P during forming images on a front surface of transfer sheet P and a correction value for correcting a skew of transfer sheet P during forming images on a rear surface of transfer sheet P.

The pair of registration rollers 43 is arranged to be perpendicular to the conveyance direction of transfer sheet P, and when transfer sheet P is caused to hit the registration rollers 43, an overall skew of the transfer sheet P is corrected. In addition, the registration rollers 43 are tilted in accordance with a correction value stored in the correction data storing section 2, and corrects a skew of the transfer sheet P. This tilt of the registration rollers 43 is controlled by roller drive control section 5. The roller drive control section 5 rotates motor M in accordance with a correction value stored in the correction data storing section 2. The motor M is connected to the registration rollers 43, and the registration rollers 43 are tilted by the motor M to correct a skew of the transfer sheet P. For the mechanism for tilting the registration rollers 43, a mechanism relating to the conventional technology can be used, and for example, the mechanism described in Unexamined Japanese Patent Application Publication No. 6-234441 can be used. Incidentally, motor M corresponds to "tilting device" of the invention.

Figure 5:
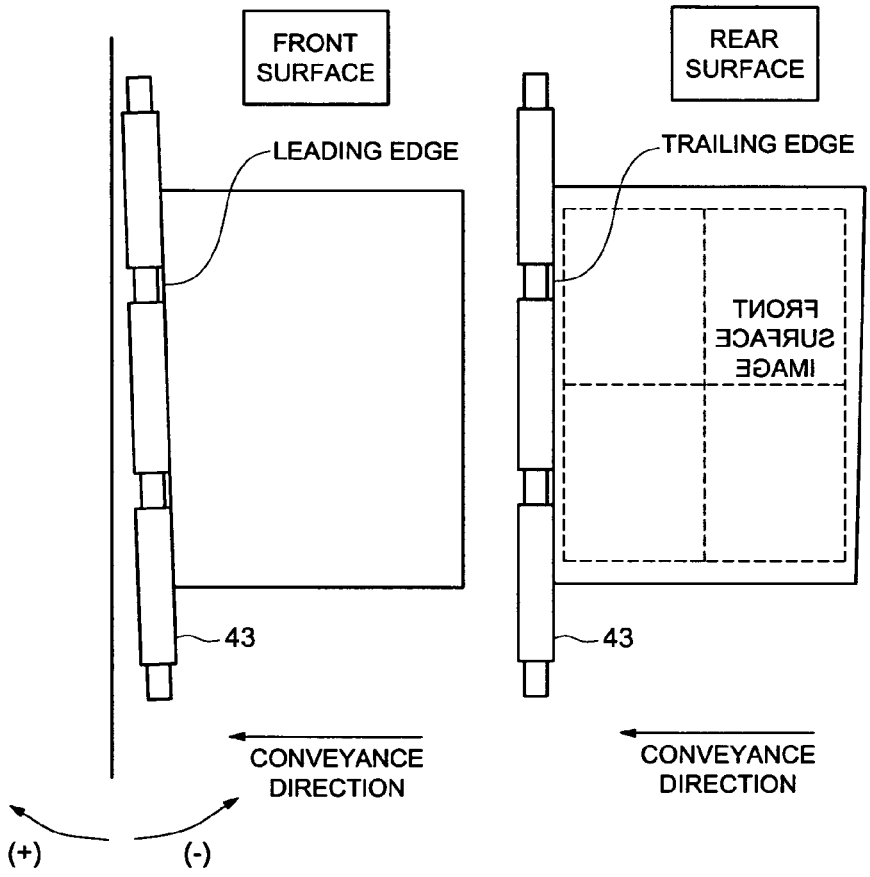
FIG. 5 is a diagram for illustrating operations to correct a skew of a transfer sheet by an image forming apparatus relating to the embodiment of the invention.

Operations of the registration rollers 43 will be explained next, referring to FIG. 5. FIG. 5 is a diagram for illustrating operations to correct a skew of a transfer sheet by an image forming apparatus relating to the embodiment of the invention. As shown in FIG. 5, the registration rollers 43 are tilted so that the end portions of the rollers which are illustrated on the lower side in the figure are shifted toward the incoming sheet (− direction) or in the opposite direction (+ direction), depending on the control of roller drive control section 5. An inclination of the registration rollers 43 corresponds to correction values (degrees) stored in correction data storing section 2. For example, if the correction value is "negative (−)", the registration rollers 43 are tilted toward the "−" direction, while, if the correction value is "positive (+)", the registration rollers 43 are tilted toward the "+" direction. By tilting the registration rollers 43, a skew of transfer sheet P that hits the registration rollers 43 is corrected.

Figure 7:
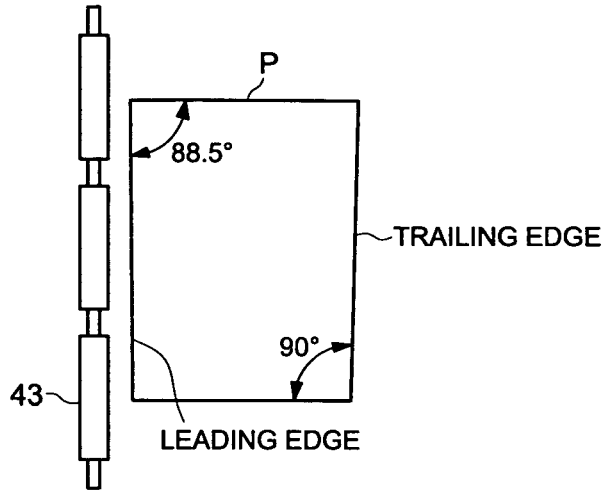
FIG. 7 is a diagram for illustrating operations for correcting a skew of a sheet by an image forming apparatus relating to conventional technology.
Figure 7:
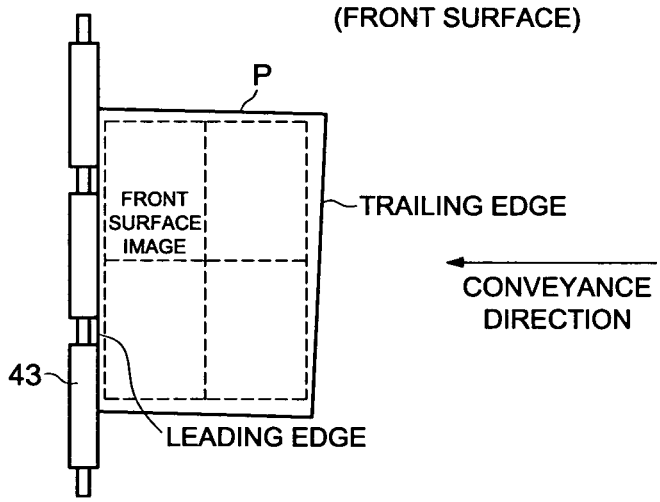
Figure 7:
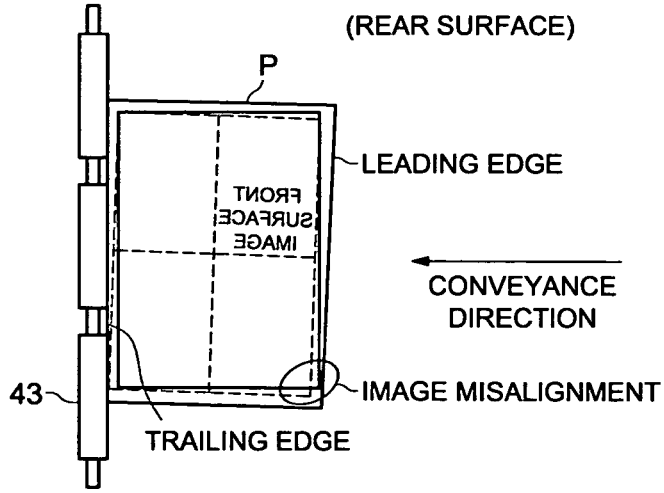

Further, since a corner angle of transfer sheet P varies depending on the corner, correction values for the front surface and those for the rear surface are stored in correction data storing section 2 as shown in FIG. 7 (*a*). In other words, when forming an image on the front surface of transfer sheet P, a skew of transfer sheet P is corrected by causing a leading edge of transfer sheet P to hit the registration rollers 43 as shown in FIG. 7 (*b*), while, when forming an image on the rear surface of transfer sheet P, the transfer sheet P is reversed and a skew of transfer sheet P is corrected by causing the trailing edge (which was a trailing edge before reversing and is a leading edge after reversing) of transfer sheet P to hit the registration rollers 43 as shown in FIG. 7 (*c*). Therefore, a side of transfer sheet P hitting the registration rollers 43 in the case of forming an image on the front surface is different from a side of transfer sheet P hitting the registration rollers 43 in the case of forming an image on the rear surface. Accordingly, correction values used for the front surface and those used for the rear surface are prepared and stored correction data storing section 2.

Further, the correction value (angle) to be used is different for each size of transfer sheet P. Specifically, a value for the occasion of transfer sheet P size of "A4" and another value for the occasion of transfer sheet P size of "B5" are prepared and stored in correction data storing section 2. Usually, transfer sheets P in a certain size are loaded in a certain sheet-feeding tray, and transfer sheets P in another size are loaded in a sheet-feeding tray that is different from the aforesaid one. Therefore, when using correction values varying for respective sizes, the correction values are stored in correction data storing section 2 to be corresponded to the number of the sheet-feeding tray. For example, trays are numbered to be "tray 1" and "tray 2", and these tray numbers and the correction values are stored to be corresponded to each other. By correlating the tray numbers with the correction values, when the tray number is designated by an operator, the registration rollers 43 are tilted based on the correction value correlated with the tray number, to correct the skew of the transfer sheet P.

It is also possible to use a correction value (angle) which is different for each manufacturer of transfer sheets P. Since there is sometimes an occasion wherein a skew of transfer sheet P is different if a transfer sheet manufacturer is different, even in the case of the transfer sheets P in the same size, it is also possible to prepare the values which vary depending on manufactures and to store them in correction data storing section 2. Further, correction values (angles) which vary depending on types of transfer sheets P may be used. Since there is sometimes an occasion wherein a skew of transfer sheet P is different depending on regular paper and glossy paper, it is also possible to prepare the values which vary depending on types of transfer sheets P and to store them in correction data storing section 2. When preparing correction values for respective transfer sheet P manufacturers and transfer sheet types, as stated above, the correction values are correlated with the manufacturers and types of transfer sheets P to be stored in correction data storing section 2. For example, a combination of manufacturers and types of transfer sheets P is made to be a sheet name, and that sheet name and the correction values are correlated with each other to be stored in correction data storing section 2. To be concrete, when a manufacturer is "manufacturer A" and a sheet type is "regular paper", a sheet name is made to be "manufacturer A regular paper" which is correlated with correction values to be stored. By correlating the sheet name with the correction values, when the sheet name is designated by an operator, the registration rollers 43 are tilted based on the correction value correlated with the sheet name, to correct the skew of the transfer sheet P.

Control section 3 reads a correction value (angle) for the surface on which an image is formed from correction data storing section 2, and outputs the correction values to roller drive control section 5. When forming an image on the front surface of transfer sheet P, for example, control section 3 reads a correction value about the front surface from correction data storing section 2, and outputs it to roller drive control section 5. When forming an image on the rear surface after image forming on the front surface of transfer sheet P has been terminated, control section 3 reads a correction value for the rear surface from correction data storing section 2, and outputs it to roller drive control section 5.

Further, when a tray number is designated from a plurality of trays installed on sheet-feeding tray 30 by an operator, control section 3 reads a correction value for transfer sheet P correlated with the designated tray number from correction data storing section 2, and outputs it to roller drive control section 5.

Further, if the sheet name of transfer sheet P is designated by an operator, control section 3 reads a correction value for transfer sheet P correlated with the designated sheet name from correction data storing section 2, and outputs it to roller drive control section 5.

In the mean time, system control section 1 is connected to respective portions of the image forming apparatus (image reading section 20, sheet supply section 40, image writing section 50, image forming section 60, fixing section 70 and the like) and controls processing of transfer, fixing and reversing.

Operation panel 4 is composed of an input portion and a display portion. The input portion includes a keyboard equipped with a cursor key, a numeral input key and respective functional keys, and a press-down signal corresponding to the key pressed on the keyboard is outputted to system control section 1. The display portion is composed of a liquid crystal display and an EL display, and it displays image data and text data on a screen in accordance with an instruction of display signals outputted from system control section 1.

A correction value (angle) for a skew of transfer sheet P is inputted by the operation panel 4. An operator inputs a correction value (angle) for a skew in the case of forming an image on the front surface and a correction value (angle) for a skew in the case of forming an image on the rear surface, by using the operation panel 4.

(Operations)

Figure 2:
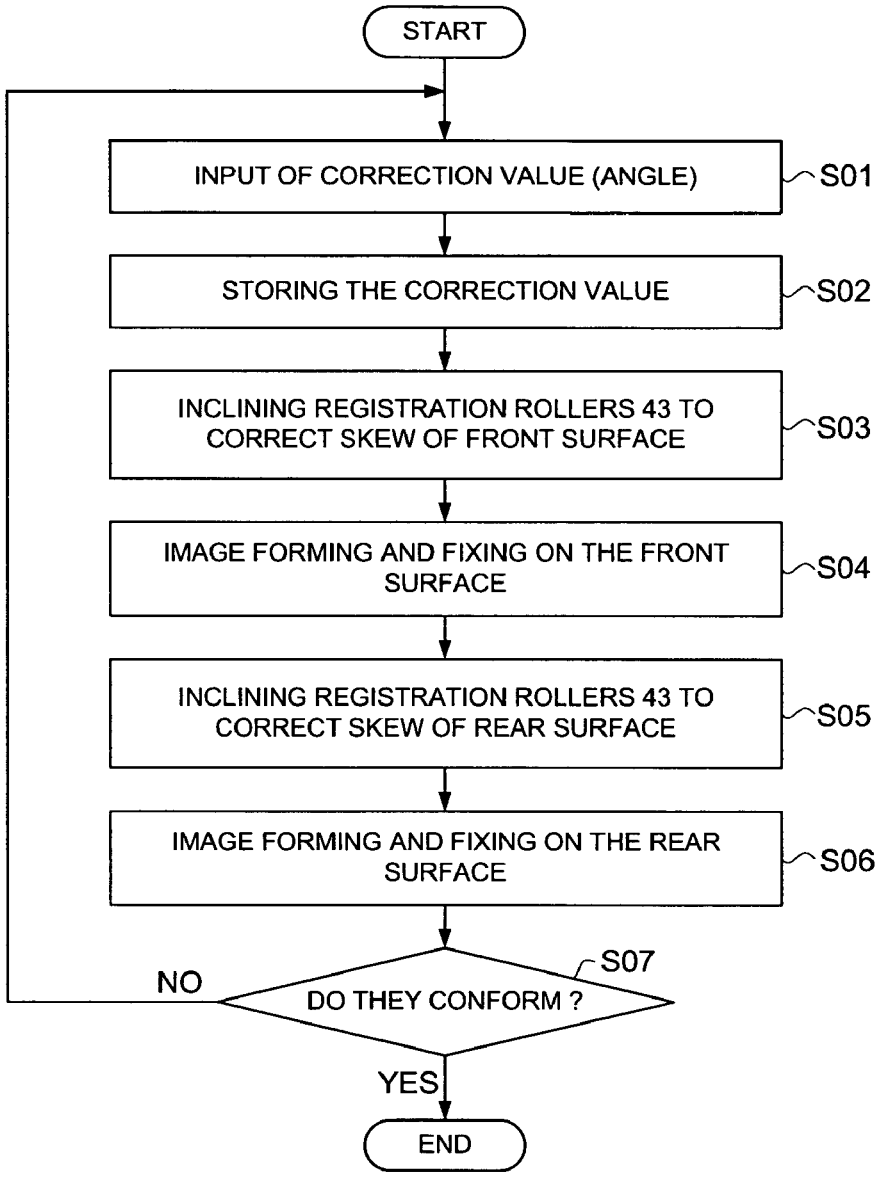
FIG. 2 is a flow chart for illustrating operations of an image forming apparatus relating to the embodiment of the invention.
Figure 3:
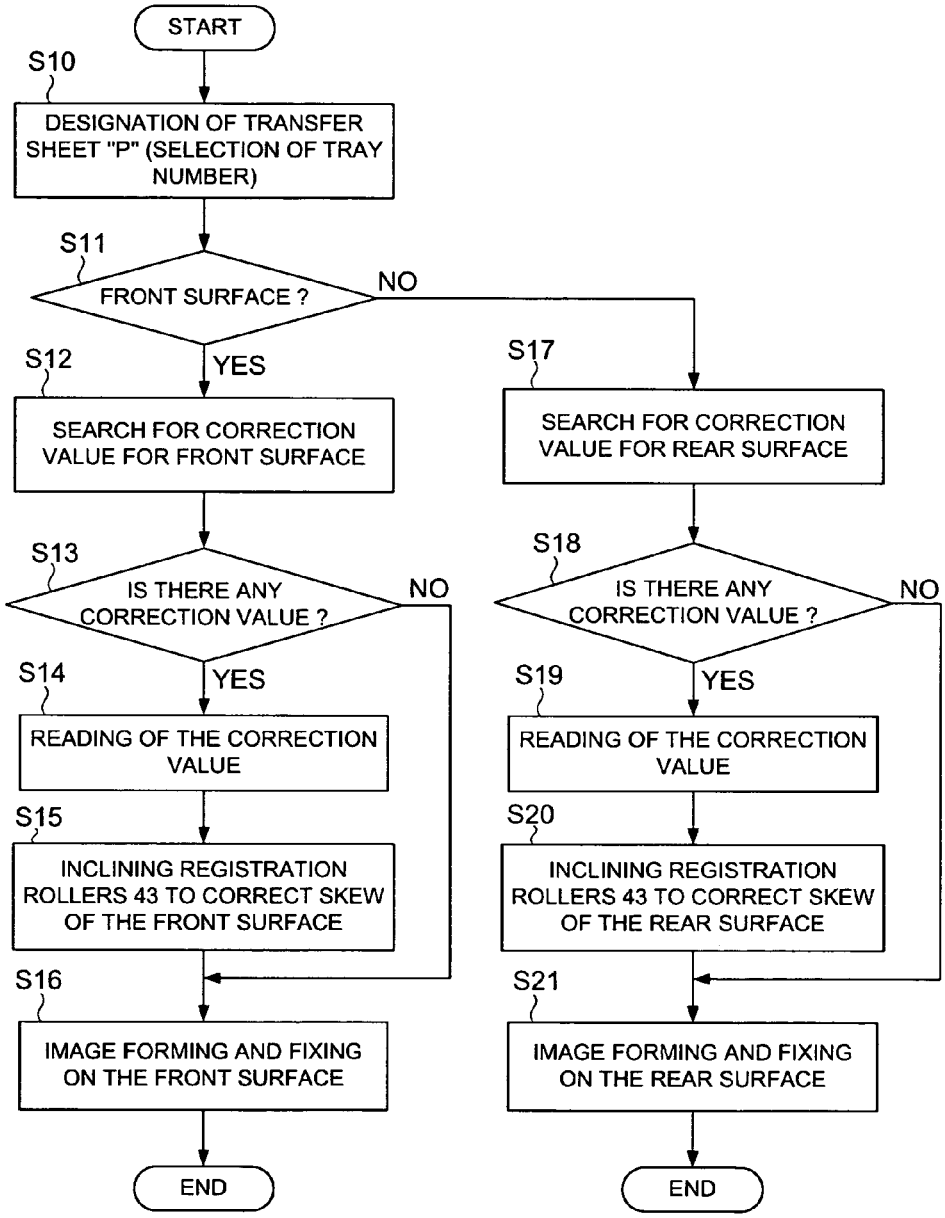
FIG. 3 is a flow chart for illustrating operations of an image forming apparatus relating to the embodiment of the invention.
Figure 4:
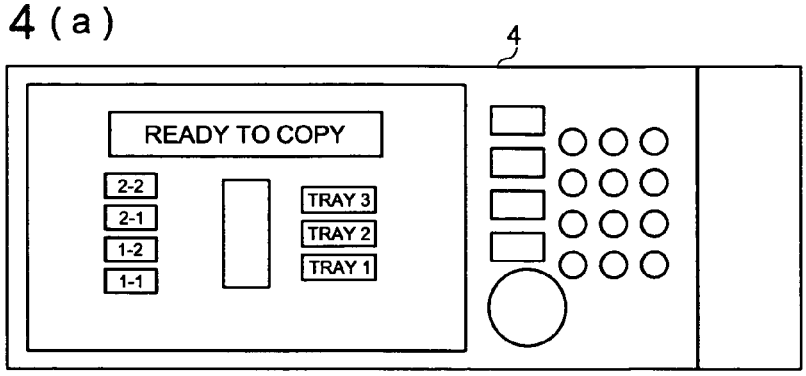
FIG. 4 is a diagram showing an operation panel installed on an image forming apparatus relating to the embodiment of the invention.
Figure 4:
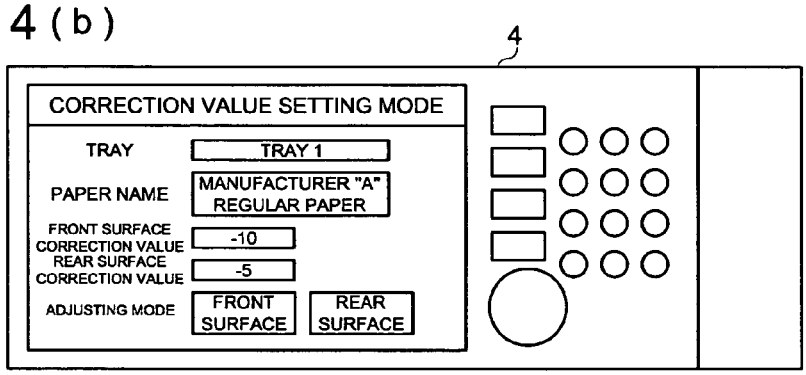
Figure 4:
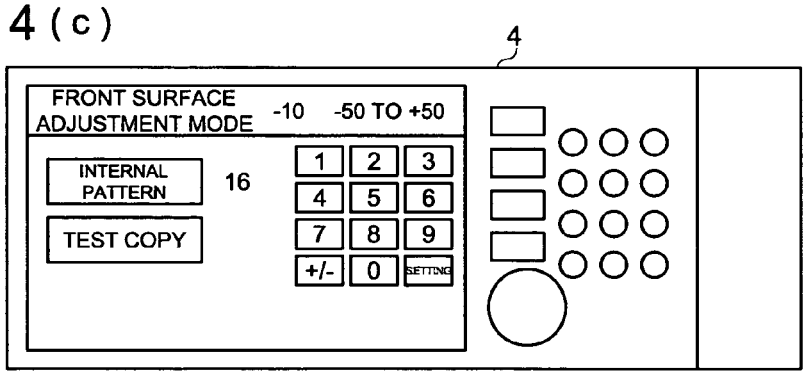
Figure 4:
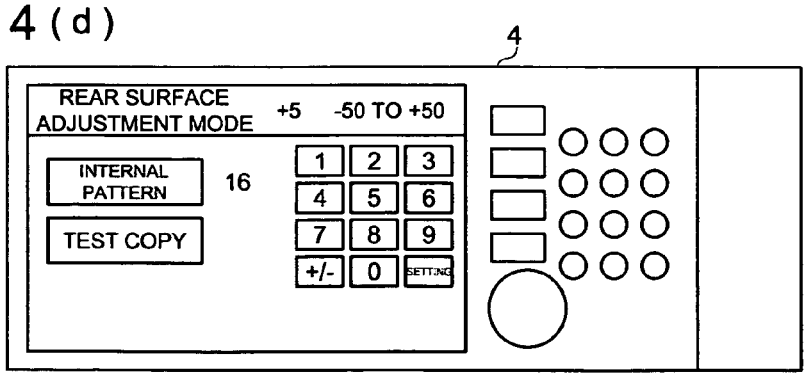

Next, operations of an image forming apparatus relating to an embodiment of the invention will be explained as follows, referring to FIGS. 1-6. Each of FIGS. 2 and 3 is a flow chart showing operational order of the image forming apparatus relating to the embodiment of the invention. FIG. 4 is a diagram showing an operation panel installed on an image forming apparatus relating to the embodiment of the invention.

First, processing for determining a correction value for correcting a skew of transfer sheet P will be explained with reference to a flow chart in FIG. 2, then, processing to correct a skew of transfer sheet P based on the determined correction value, and to conduct printing actually will be explained with reference to a flow chart in FIG. 3.

(Step S01)

First, in step S01, an operator inputs a correction value for a skew of transfer sheet P by using operation panel 4. An example of this inputting will be explained with reference to FIG. 4. If the correction value setting mode for a skew of transfer sheet P is selected on the operation panel 4, a setting screen where a correction value or the like is inputted is displayed on the operation panel 4 as shown in FIG. 4 (*b*).

In the setting screen shown in FIG. 4(*b*), there are included, for example, an input column for the tray number of sheet-feeding tray 30, an input column for the sheet name and an input column for the correction value (angle) for a skew.

In the input column for the tray number, there is inputted, for example, "Tray 1" or "Tray 2" that is given to each tray. In the input column for the sheet name, there is inputted a name of a manufacturer or a sheet name of transfer sheet P. The input column for the correction value for a skew includes a column where a correction value for the skew on the front surface is inputted and a column where a correction value for the skew on the rear surface is inputted. As correction values, the numerical value and a direction of inclination are inputted. The direction of the inclination is expressed with "+" or "−". This inclination direction "+" or "−" corresponds to the direction of the inclination of registration rollers 43 shown in FIG. 5. Namely, if the "+" direction is inputted in the input column of operation panel 4, the registration rollers 43 are tilted in the "+" direction in FIG. 5, while, if the "−" direction is inputted in the input column, the registration rollers 43 are tilted in the "−" direction in FIG. 5.

As an example of input, "Tray 1" is inputted in the input column for the tray number, "manufacturer A regular paper" is inputted in the input column for the sheet name, and "−10" is inputted as a correction value for the front surface, and "+5" is inputted as a correction value for the rear surface, both in the input column for the correction value, as shown in FIG. 4 (*b*).

(Step S02)

Next, in step S02, the correction value (angle) inputted on operation panel 4 is stored in correction data storing section 2. When the tray number of sheet-feeding tray 30 is inputted on operation panel 4, the tray number and the correction value are stored in correction data storing section 2 to be correlated with each other. When the sheet name is inputted on operation panel 4, the sheet name and the correction value are correlated with each other to be stored in correction data storing section 2.

(Step S03)

In step S03, a skew of transfer sheet P is corrected when an image is formed on the front surface of the transfer sheet P. In this case, "front surface adjustment mode" is displayed on operation panel 4 as shown in FIG. 4 (*c*), and the correction value "−10" for the skew of the front surface is displayed. Control section 3 reads the correction value for the skew of the front surface from correction data storing section 2, and outputs it to roller drive control section 5. After receiving the correction value from the control section 3, the roller drive control section 5 tilts registration rollers 43 by an amount equivalent to the correction value. For example, if the correction value for the skew of the front surface is assumed to be "−10", the roller drive control section 5 tilts registration rollers 43 toward the "−" direction by an amount of angle equivalent to the correction value as shown in FIG. 5. Then, it corrects the skew of the front surface by causing a leading edge of transfer sheet P to hit a nip portion of registration rollers 43.

(Step S04)

After the skew for the front surface has been corrected in step S03, a toner image is transferred onto transfer sheet P in image forming section 60, and the transferred toner image is fixed in fixing section 70, in the same way as in the conventional technology. Then, for forming an image on the rear surface, the transfer sheet P is sent again to image forming section 60 under the condition that the transfer sheet P has been reversed by reversing path 84, reversing conveyance roller 85 and reversing conveyance path 86.

(Step S05)

In step S05, a skew of transfer sheet P is corrected when an image is formed on the rear surface of the transfer sheet P. In this case, "rear surface adjustment mode" is displayed on operation panel 4 as shown in FIG. 4 (*d*), and the correction value "+5" for the skew of the rear surface is displayed. Control section 3 reads the correction value for the skew of the front surface from correction data storing section 2, and outputs it to roller drive control section 5. After receiving the correction value from the control section 3, the roller drive control section 5 tilts registration rollers 43 by an amount equivalent to the correction value. For example, if the correction value for the skew of the rear surface is assumed to be "+5", the roller drive control section 5 tilts registration rollers 43 toward the "+" direction by an amount of angle equivalent to the correction value as shown in FIG. 5. Then, it corrects the skew of the rear surface by causing the trailing edge of transfer sheet P to hit a nip portion of registration rollers 43.

(Step S06)

After the skew for the rear surface has been corrected in step S05, a toner image is transferred onto transfer sheet P in image forming section 60, and the transferred toner image is fixed in fixing section 70, in the same way as in the conventional technology. The transfer sheet P on which the image fixing has been completed on each of the front surface and the rear surface in the aforesaid way is ejected by sheet ejection roller 81 to sheet ejection tray 82.

(Step S07)

In step S07, an operator judges positional displacement between an image formed on one side and an image formed on the other side of transfer sheet P. In other words, the operator judges whether images formed on both sides of transfer sheet P agree in terms of position with each other or not. Then, when the operator judges images formed on both sides to agree with each other in terms of position (step S07, Yes), adjustment of correction values is terminated.

When images formed on both sides are judged not to agree with each other in terms of position (step S07, No), processes from step S01 to step S06 are conducted again, and images on both sides are judged whether they agree with each other in terms of position or not. In this case, correction values for the skew are changed so that images on both sides may agree with each other in terms of position, and processes from step S01 to step S06 are conducted.

When images formed on both sides are judged to agree with each other in terms of position, correction values for the skew are stored in correction data storing section 2. In this case, tray numbers are correlated with correction values or sheet names are correlated with correction values to be stored in correction data storing section 2.

When transfer sheet P has plural sizes or when transfer sheet P has plural types, correction values for the skew of transfer sheet P are determined by conducting processes from step S01 to step S07 for respective sizes and respective types, and these correction values are correlated with tray numbers or with sheet names to be stored in correction data storing section 2.

Next, processing to conduct printing actually by correcting the skew of transfer sheet P based on the correction value determined by processes from the aforesaid step S01 to step S07 will be explained with reference to a flow chart in FIG. 3.

(Step S10)

First, transfer sheet P for printing is designated by an operator. For example, the tray on which the transfer sheet P for printing is loaded is designated, or the name of the transfer sheet P is designated, by the operator. As shown in FIG. 4 (*a*), a screen for selecting the tray number is displayed on operation panel 4, for example. The operator selects, from the screen, the number of the tray on which the transfer sheet P for printing is loaded.

(Step S11, Step S12)

When forming an image on the front surface of transfer sheet P (Step S11, Yes), control section 3 detects the correction value correlated with the tray number or the sheet name designated in step 10, with reference to correction data storing section 2.

(Step S13, Step S14)

Then, when the correction value correlated with the designated tray number or the designated sheet name exists in correction data storing section 2 (Step S13, Yes), the control section 3 reads the correction value for correcting the skew of the front surface from the correction data storing section 2, and outputs it to roller drive control section 5.

(Step S15)

In step S15, the skew of transfer sheet P is corrected when forming an image on the front surface of the transfer sheet P. After receiving the correction value from the control section 3, the roller drive control section 5 tilts registration rollers 43 by an amount equivalent to the correction value. For example, when the correction value for the skew of the front surface is set to "−10", the roller drive control section 5 tilts registration rollers 43 toward the "−" direction by an amount of angle equivalent to the correction value as shown in FIG. 5. Then, it corrects the skew concerning the front surface by causing a leading edge of transfer sheet P to hit a nip portion of registration rollers 43.

(Step S16)

After the skew for the front surface has been corrected in step S15, a toner image is transferred onto transfer sheet P in image forming section 60, and the transferred toner image is fixed by fixing section 70, in the same way as in the conventional technology.

(Step S11, Step S17)

Further, when forming an image on the rear surface of transfer sheet P (Step S11, No), control section 3 detects the correction value correlated with the tray number or the sheet name designated in step 10, with reference to correction data storing section 2.

(Step S18, Step S19)

Then, when the correction value correlated with the designated tray number or the designated sheet name exists in correction data storing section 2 (Step S18, Yes), the control section 3 reads the correction value for correcting the skew of the rear surface from the correction data storing section 2, and outputs it to roller drive control section 5.

(Step S20)

In step S20, the skew of transfer sheet P is corrected when forming an image on the rear surface of the transfer sheet P. After receiving the correction value from the control section 3, the roller drive control section 5 tilts registration rollers 43 by an amount equivalent to the correction value. For example, when the correction value for the skew of the rear surface is set to "+5", the roller drive control section 5 tilts registration rollers 43 toward the "+" direction by an amount of angle equivalent to the correction value. Then, it corrects the skew concerning the rear surface by causing the trailing edge of transfer sheet P to hit a nip portion of registration rollers 43.

(Step S21)

After the skew for the rear surface has been corrected in step S20, a toner image is transferred onto transfer sheet P in image forming section 60, and the transferred toner image is fixed by fixing section 70, in the same way as in the conventional technology. Thus, the transfer sheet P on which image fixing has been terminated on each of the front surface and the rear surface is ejected onto sheet ejection tray 82 by sheet ejection rollers 81.

Owing to the aforesaid processes from step S10 to step S21, images are formed on both sides of transfer sheet P. Then, a correction value for a skew is changed for each transfer sheet P, and further, a correction value is changed between the front surface and the rear surface, whereby, it is possible to cause images formed on both sides of transfer sheet P to agree highly accurately in terms of position with each other.

Though the skew of transfer sheet P was corrected by tilting registration rollers 43 in the embodiment stated above, it is also possible to form an image on transfer sheet P by tilting the image in accordance with the skew of transfer sheet P. In this case, image forming section 60 transfers a toner image onto transfer sheet P by tilting the toner image in accordance with the skew of the transfer sheet P. When transferring a toner image onto the front surface of transfer sheet P, a toner image is tilted in accordance with a skew of the front surface to be transferred onto transfer sheet P, and when transferring a toner image onto the rear surface of transfer sheet P, a toner image is tilted in accordance with a skew of the rear surface to be transferred onto transfer sheet P. Even when tilting the toner image in accordance with a skew of transfer sheet P for transferring the toner image as in the aforesaid way, it is also possible to cause images on both sides to agree highly accurately in terms of position with each other.

When forming images on both sides of a transfer sheet, the present invention makes it possible to cause images on both sides to agree highly accurately in terms of position with each other.

What is claimed is:

1. An image forming apparatus which forms images on both sides of a transfer sheet, the image forming apparatus comprising:

an image forming device which forms an image on a front surface of the transfer sheet and then forms an image on a rear surface of the transfer sheet;

a conveying device for conveying the transfer sheet to the image forming device in a conveyance direction; and a control section for controlling the conveying device, wherein the conveying device comprises:

paired registration rollers arranged in a direction perpendicular to the conveyance direction of the transfer sheet for being hit by the transfer sheet; and a tilting device which changes an inclination of the paired registration rollers from the direction perpendicular to the conveyance direction, wherein when forming an image on the front surface of the transfer sheet by the image forming device, the tilting device changes the inclination of the paired registration rollers according to a first skew amount of a first side of the transfer sheet representing a leading edge in the conveyance direction before the transfer sheet hits the paired registration rollers and, after the transfer sheet hits the paired registration rollers, the control section controls so as to convey the transfer sheet while keeping a state of the paired registration rollers whose inclination has been changed by the tilting device, and wherein when forming an image on the rear surface of the transfer sheet by the image forming device, the tilting device changes the inclination of the paired registration rollers according to a second skew amount of a second side of the transfer sheet representing a leading edge in the conveyance direction before the transfer sheet hits the paired registration rollers, and, after the transfer sheet hits the paired registration rollers, the control section controls so as to convey the transfer sheet while keeping a state of the paired registration rollers whose inclination has been changed by the tilting device.

2. The image forming apparatus of claim 1, wherein the tilting device changes the inclination of the paired registration rollers according to at least one of the first skew amount and the second skew amount which have been set for each transfer sheet.

3. The image forming apparatus of claim 1, wherein the tilting device changes the inclination of the paired registration rollers according to at least one of the first skew amount and the second skew amount which have been set for each type of the transfer sheet.

4. The image forming apparatus of claim 1, wherein the tilting device changes the inclination of the paired registration rollers according to at least one of the first skew amount and the second skew amount which have been set for each sheet-feeding tray feeding the transfer sheet.

5. The image forming apparatus of claim 1 further comprising, a correction data storing section for storing at least one of the first skew amount and the second skew amount in advance.

6. The image forming apparatus of claim 1 further comprising, an operation panel for inputting at least one of the first skew amount and the second skew amount.

7. The image forming apparatus of claim 1, wherein the first skew amount and the second skew amount are based on angles at corners of the transfer sheet.

8. An image forming method for forming images on both sides of a transfer sheet, the image forming method comprising the steps of:

forming an image on a front surface of the transfer sheet and then forming an image on a rear surface of the transfer sheet;

conveying the transfer sheet to the image forming device in a conveyance direction; and controlling paired registration rollers arranged in a direction perpendicular to the conveyance direction of the transfer sheet for being hit by the transfer sheet and a tilting device which changes an inclination of the paired registration rollers from the direction perpendicular to the conveyance direction, wherein when forming an image on the front surface of the transfer sheet in the forming step, the controlling step comprises:

causing the tilting device to change the inclination of the paired registration rollers according to a first skew amount of a first side of the transfer sheet representing a leading edge in the conveyance direction before the transfer sheet hits the paired registration rollers, and conveying the transfer sheet while keeping a state of the paired registration rollers whose inclination has been changed by the tilting device after the transfer sheet hits the paired registration rollers, and wherein when forming an image on the rear surface of the transfer sheet in the forming step, the controlling step comprises:

causing the tilting device to change the inclination of the paired registration rollers according to a second skew amount of a second side of the transfer sheet representing a leading edge in the conveyance direction before the transfer sheet hits the paired registration rollers, and conveying the transfer sheet while keeping a state of the paired registration rollers whose inclination has been changed by the tilting device after the transfer sheet hits the paired registration rollers.

9. The image forming method of claim 8 further comprising, storing at least one of the first skew amount and the second skew amount in a correction data storing section in advance.

10. The image forming method of claim 8 further comprising, inputting at least one of the first skew amount and the second skew amount by an operation panel.

11. The image forming method of claim 8, wherein the first skew amount and the second skew amount are based on angles at corners of the transfer sheet.

* * * * *